US007204579B2

(12) United States Patent
Kodama

(10) Patent No.: US 7,204,579 B2
(45) Date of Patent: Apr. 17, 2007

(54) DROPLET DISCHARGING HEAD AND INKJET RECORDING APPARATUS

(75) Inventor: Kenichi Kodama, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 186 days.

(21) Appl. No.: 10/947,303

(22) Filed: Sep. 23, 2004

(65) Prior Publication Data

US 2005/0110833 A1 May 26, 2005

(30) Foreign Application Priority Data

Sep. 24, 2003 (JP) ..... 2003-332465

(51) Int. Cl.
*B41J 2/135* (2006.01)
*B41J 2/045* (2006.01)

(52) U.S. Cl. ..... 347/46; 347/68

(58) Field of Classification Search ..... 347/46, 347/68–72

See application file for complete search history.

(56) References Cited

U.S. PATENT DOCUMENTS

| | | | | |
|---|---|---|---|---|
| 4,525,728 | A | 6/1985 | Koto | |
| 6,328,395 | B1 * | 12/2001 | Kitahara et al. | 347/9 |
| 6,371,603 | B1 | 4/2002 | Seto | |
| 6,508,538 | B2 * | 1/2003 | Suzuki et al. | 347/43 |
| 6,695,437 | B2 * | 2/2004 | Nakamura et al. | 347/70 |
| 2002/0063757 | A1 * | 5/2002 | Kanda et al. | 347/71 |
| 2003/0054541 | A1 | 3/2003 | Noritake et al. | |

FOREIGN PATENT DOCUMENTS

| | | | |
|---|---|---|---|
| JP | 58-7363 | A | 1/1983 |
| JP | 5-246026 | A | 9/1993 |
| JP | 7-60957 | A | 3/1995 |
| JP | 7-60958 | A | 3/1995 |
| JP | 2001-146010 | A | 5/2001 |
| JP | 2001-260347 | A | 9/2001 |
| JP | 2003-75305 | A | 3/2003 |

* cited by examiner

*Primary Examiner*—Manish S. Shah
*Assistant Examiner*—Lisa M. Solomon
(74) *Attorney, Agent, or Firm*—Birch, Stewart, Kolasch & Birch, LLP

(57) ABSTRACT

The droplet discharging head comprises: nozzles which discharge droplets; pressure chambers which are connected to the nozzles and are filled with a liquid to be discharged from the nozzles; devices which generate pressure for causing pressure change in liquid inside the pressure chambers, and thereby cause droplet to be discharged from corresponding nozzle; a plurality of pressure chambers disposed in a structure wherein flow passage distance of nozzle side from each of the pressure chambers to the corresponding nozzles are different; and nozzle supply passages which are formed to have flow passage shapes whereby acoustic resistance and acoustic inertance of each nozzle supply passage are approximately same regardless of the flow passage distance, from each of the plurality of pressure chambers to the corresponding nozzles.

9 Claims, 14 Drawing Sheets

FIG.3

EXAMPLE OF SPECIFIED DIMENSIONS

| PLATE MEMBERS | THICKNESS OF EACH LAYER (μm) | SIZE OF FLOW PASSAGE / PRESSURE CHAMBER (μm) |
|---|---|---|
| SECOND VIBRATION PLATE (23) | 20～70 | |
| SECOND PRESSURE CHAMBER PLATE (22) | 100～300 | SECOND PRESSURE CHAMBER : 200～500 |
| SECOND COMMON FLOW PASSAGE SUPPLY PATH PLATE (21) | 20～70 | SECOND SUPPLY SIDE SUPPLY PASSAGE : 20～50 |
| SECOND COMMON FLOW PASSAGE PLATE (20) | 100～300 | SECOND COMMON PASSAGE : 100～40 |
| THIRD NOZZLE SUPPLY PASSAGE PLATE (19) | 50～200 | |
| PIEZOELECTRIC ELEMENT AVOIDING PLATE (18) | 100～200 | |
| FIRST VIBRATION PLATE (17) | 20～70 | |
| FIRST PRESSURE CHAMBER PLATE (16) | 100～300 | FIRST PRESSURE CHAMBER : 200～50 |
| FIRST COMMON FLOW PASSAGE SUPPLY PASSAGE PLATE (15) | 20～70 | FIRST SUPPLY SIDE SUPPLY PASSAGE : 20～50 |
| FIRST COMMON FLOW PASSAGE PLATE (14) | 100～300 | FIRST COMMON PASSAGE : 100 ～40 |
| SECOND NOZZLE SUPPLY PASSAGE PLATE (13) | 100～300 | |
| FIRST NOZZLE SUPPLY PASSAGE PLATE (12) | DESIGNED AS APPROPRIATE | |
| NOZZLE PLATE (11) | 20～70 | NOZZLE PATH : 20～50 |

FIG.5A
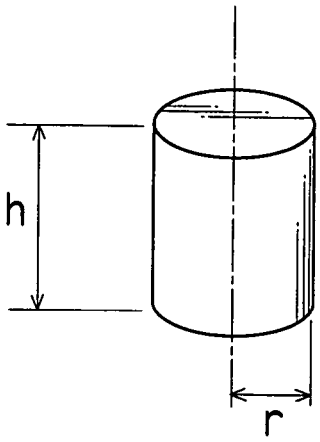
FIG.5B
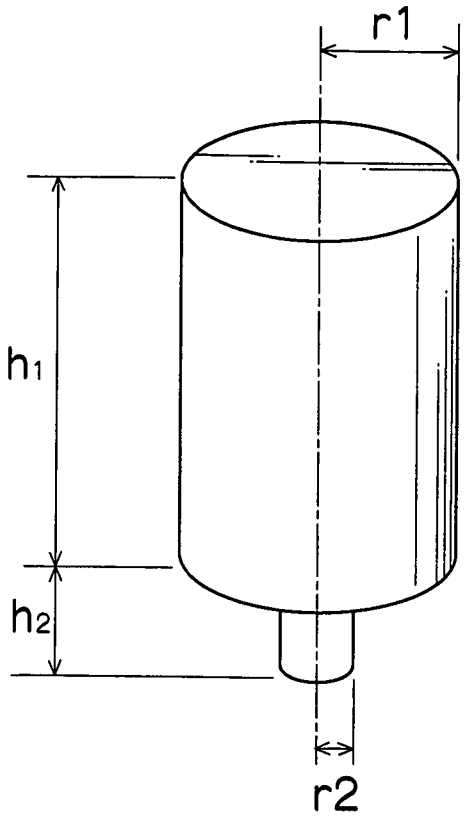
FIG.6
SHAPE OF (A)
| h (μm) | r (μm) | s=π・r² | L=h/s | R=h/s² |
|---|---|---|---|---|
| 500 | 70 | 1.54E+04 | 3.25E-02 | 2.11E-06 |

SHAPE OF (B)

| $h_1$ (μm) | $r_1$ (μm) | $s_1$ (μm$^2$) | $r_2$ (μm) | $s_2$ (μm$^2$) | $h_2$ (μm) |
|---|---|---|---|---|---|
| 500 | 70.2 | 1.55E+04 | 49 | 7.54E+03 | 1 |
| 520 | 78.9 | 1.96E+04 | 50 | 7.85E+03 | 46 |
| 550 | 84.6 | 2.25E+04 | 50 | 7.85E+03 | 63 |
| 600 | 92 | 2.66E+04 | 50 | 7.85E+03 | 78 |
| 650 | 98 | 3.02E+04 | 50 | 7.85E+03 | 86 |
| 700 | 104 | 3.38E+04 | 50 | 7.85E+03 | 92 |
| 800 | 114 | 4.05E+04 | 50 | 7.85E+03 | 100 |
| 900 | 123 | 4.71E+04 | 50 | 7.85E+03 | 105 |
| 1000 | 131 | 5.37E+04 | 50 | 7.85E+03 | 109 |
| 1100 | 138 | 6.01E+04 | 50 | 7.85E+03 | 111 |
| 1200 | 146 | 3.35E+04 | 50 | 7.85E+03 | 113 |

SHAPE OF (B)

| $h_1$ (μm) | $r_1$ (μm) | $s_1$ (μm$^2$) | $r_2$ (μm) | $s_2$ (μm$^2$) | $h_2$ (μm) |
|---|---|---|---|---|---|
| 1000 | 101 | 3.22E+04 | 20 | 1.26E+03 | 2 |
| 1000 | 105 | 3.46E+04 | 30 | 2.83E+03 | 10 |
| 1000 | 113 | 4.00E+04 | 40 | 5.03E+03 | 37 |
| 1000 | 131 | 5.37E+04 | 50 | 7.85E+03 | 109 |
| 1000 | 181 | 1.03E+04 | 60 | 1.13E+03 | 258 |
| 1000 | 1851 | 1.08E+04 | 69.9 | 1.53E+03 | 497 |
| 1000 | 5856 | 1.08E+04 | 69.99 | 1.54E+03 | 500 |

RECTANGULAR DRIVE

| TIME ($\mu$s) | PRESSURE (Pa) |
|---|---|
| 0 | 0E+5 |
| 1.5 | 1E+5 |
| 5 | 1E+5 |
| 7 | 0E+5 |

DROPLET DISCHARGING HEAD AND INKJET RECORDING APPARATUS

This Non-provisional application claims priority under 35 U.S.C. § 119(a) on Patent Application No(s). 2003-332465 filed in Japan on Sep. 24, 2003, the entire contents of which are hereby incorporated by reference.

BACKGROUND OF THE INVENTION

1. Field of the Invention

The present invention relates to a droplet discharging head and inkjet recording apparatus, and more particularly, to a structure of a droplet discharging head that is suitable for increasing the density of nozzles (droplet discharge ports), and to an inkjet recording apparatus using same.

2. Description of the Related Art

An inkjet recording apparatus is an apparatus for forming images by means of ink dots, by causing ink to be discharged from a recording head comprising nozzles for discharging ink, in accordance with a print signal, thereby causing ink droplets to land on a recording medium, such as recording paper, or the like, while moving the recording medium relatively with respect to the recording head. In recent years, recording heads have been proposed wherein pressure chambers connected to nozzles are disposed in a three-dimensional fashion, by means of a layered structure, in order to achieve higher density of nozzles in order to respond to high levels of resolution in images (see Japanese Patent Application Publication No. 2001-146010, and Japanese Patent Application Publication No. 2001-260347).

In Japanese Patent Application Publication No. 2001-146010, a head unit consisting of pressure chambers and piezoelectric elements has a structure which is layered in two levels, an upper and a lower level, a common nozzle plate being provided in the lower first-level head unit only, and ink inside the pressure chambers in the upper level (second-level head unit) being discharged from nozzles via connecting holes passing through the first-level head unit.

In Japanese Patent Application Publication No. 2001-260347, first pressure chambers corresponding respectively to every other nozzle of a plurality of nozzles arranged in a row, and second pressure chambers corresponding to the remaining nozzles are disposed in a layered fashion, and two piezoelectric actuators corresponding to two pressure chambers are layered respectively thereon, via a rigid plate.

However, in the structures proposed in the prior art, since the distance from the pressure chamber to the nozzle differs between the upper level and the lower level, then the discharge performances are different in the respective layers. Therefore, if image recording is carried out using a convention recording head of this kind, unevenness of streaking may arise in the image, in accordance with the layers in which the pressure chambers are positioned.

SUMMARY OF THE INVENTION

The present invention was devised with this situation in view, an object thereof being to provide a structure for a droplet discharging head, and an inkjet recording apparatus using same, wherein a plurality of discharge passage systems are provided, each having different positional structures of the pressure chambers with respect to the nozzles, and different positional structures of the pressure chambers with respect to a common flow passage, but wherein the differences in the discharge performance between respective nozzles are reduced.

The invention for achieving the above-stated object provides a droplet discharging head comprising: nozzles which discharge droplets; pressure chambers which are connected to the nozzles and are filled with a liquid to be discharged from the nozzles; devices which generate pressure for causing pressure change in liquid inside the pressure chambers, and thereby cause droplet to be discharged from corresponding nozzle; a plurality of pressure chambers disposed in a structure wherein flow passage distance of nozzle side from each of the pressure chambers to the corresponding nozzles are different; and nozzle supply passages which are formed to have flow passage shapes whereby acoustic resistance and acoustic inertance of each nozzle supply passage are approximately same regardless of the flow passage distance, from each of the plurality of pressure chambers to the corresponding nozzles.

According to the droplet discharging head described in the invention, since the shape (including the structure) of the nozzle supply passages in a plurality of discharge flow passage systems of different flow passage distances from the pressure chamber to the nozzle are designed in such a manner that the acoustic resistance and the acoustic inertance of the flow passages (nozzle supply passages) from the pressure chambers to the nozzles are approximately the same, then it is possible approximately to equalize the droplet discharge performance (volume of droplet, discharge speed, discharge direction, and the like) in each of the nozzles.

Preferably, the droplet discharging head further comprises a nozzle plate formed with a plurality of nozzles corresponding to the plurality of pressure chambers; and a plurality of pressure chambers being disposed at different distances with respect to the nozzle plate.

By disposing the pressure chambers in a layered structure with respect to the nozzle plate, it is possible to increase the density of the nozzle positions, while at the same time equalizing the discharge performance.

Preferably, acoustic resistance and acoustic inertance are made to be approximately same in each of the nozzle supply passages, by setting values of at least one of cross-sectional area and length of the nozzle supply passage to be mutually different values, with respect to each of the plurality of pressure chambers having different the flow passage distances of nozzle side.

Preferably, the nozzle supply passage which connected to at least one pressure chamber of the plurality of pressure chambers having different flow passage distances of nozzle side, has a structure in which two or more flow passages of mutually different cross-sectional areas are combined.

Preferably, the droplet discharging head is formed by laminating a plurality of plate members, and has a structure which is changed cross-sectional area of flow passages at boundary faces between laminated plate members.

According to invention, it is possible to process the holes of the nozzle supply passages readily, by using processing technology such as etching, or the like.

Preferably, the nozzle supply passage has a structure whereby cross-sectional area decreases gradually from the pressure chamber towards the nozzle.

Preferably, the droplet discharging head further comprises a common flow passage connected to the pressure chambers, for supplying a liquid to the pressure chambers; and a supply side supply passage whose shape is approximately same for each of the plurality of pressure chambers, from the common flow passage to the pressure chamber.

According to those modes of invention, it is possible to equalize the acoustic resistance and the acoustic inertance of the supply side supply passages, and hence the supply characteristics (refill response characteristics) of the liquid with respect to the pressure chambers are equalized. In the present invention, a mode can be adopted wherein a plurality of common flow passages are provided independently for the pressure chambers having different disposition structures with respect to the nozzle, or a mode can be adopted wherein common (one) flow passage, which is common to all of the pressure chambers, is provided.

Furthermore, the present invention provides a droplet discharging head, comprising: nozzles which discharge droplets; pressure chambers which are connected to the nozzles and are filled with a liquid to be discharged from the nozzles; a common flow passage connected to the pressure chambers, for storing a liquid to be supplied to the pressure chambers; devices which generate pressure for causing pressure change in liquid inside the pressure chambers, and thereby cause droplet to be discharged from corresponding nozzle; a plurality of pressure chambers disposed in a structure wherein flow passage distance of supply side from each of the pressure chambers to the corresponding nozzles are different; and supply side supply passages which are formed to have flow passage shapes whereby acoustic resistance and acoustic inertance of each supply side supply passage are approximately same regardless of the flow passage distance, from each of the plurality of pressure chambers to the corresponding nozzles.

According to the invention above, since the shape (including the structure) of the supply side supply passages in a plurality of discharge flow passage systems of different flow passage distances from the common flow passage to the pressure chambers are designed in such a manner that the acoustic resistance and the acoustic inertance of the flow passages (supply side supply passages) connecting the common flow passage to the pressure chambers are approximately the same, then it is possible approximately to equalize the supply characteristics on the supply side. By this means, it is possible to seek to equalize the droplet discharge performance from the nozzles.

Preferably, acoustic resistance and acoustic inertance are made to be approximately same in each of the supply side supply passages, by setting values of at least one of cross-sectional area and length of the nozzle supply passage to be mutually different values, with respect to each of the plurality of pressure chambers having different the flow passage distances of supply side.

Preferably, the supply side supply passage which connected to at least one pressure chamber of the plurality of pressure chambers having different flow passage distances of supply side, has a structure in which two or more flow passages of mutually different cross-sectional areas are combined.

Preferably, the droplet discharging head is formed by laminating a plurality of plate members, and has a structure which is changed cross-sectional area of flow passages at boundary faces between laminated plate members.

In the invention, approximately equal discharge performance is obtained by driving the devices generating pressure change by means of different drive waveforms, with respect to each of the plurality of pressure chambers having different flow passage distances of nozzle side or different flow passage distances of supply side.

Preferably, in addition to designing the flow passages in such a manner that the acoustic resistance and the acoustic inertance are matching in each passage, the pressure generating devices are also driven by means of respectively suitable drive waveforms.

The present invention is also directed to an inkjet recording apparatus, comprising: an inkjet recording head including the above-described droplet discharging head, wherein image is recorded onto a recording medium by discharging ink droplets from nozzles, while causing the recording medium to move relatively with respect to the inkjet recording head.

In implementing the present invention, the mode of the recording head is not limited in particular, and it may be a shuttle type recording head wherein printing is carried out while moving the recording head back and forth in a direction that is approximately orthogonal to the direction of conveyance of the recording medium, or it may be a full line type recording head having a row of nozzles wherein a plurality of nozzles for discharging ink are arranged along a length corresponding to the full width of the print medium in a direction that is approximately orthogonal to the direction of conveyance of the print medium.

A "full line type recording head" is usually disposed following a direction that is orthogonal to the relative direction of conveyance of the recording medium, but modes may also be adopted wherein the recording head is disposed following an oblique direction that forms a prescribed angle with respect to the direction orthogonal to the conveyance direction. Furthermore, the arrangement of the nozzles in the recording head is not limited to being a single line type arrangement, and a matrix arrangement comprising a plurality of rows may also be adopted. Moreover, a mode may also be adopted wherein a row of image recording elements corresponding to the full width of the recording paper is constituted by combining a plurality of short dimension recording head units having nozzle rows which do not reach a length corresponding to the full width of the recording medium.

"Recording medium" indicates a medium on which an image is recorded by means of the action of the recording head (this medium may also be called a print medium, image forming medium, recording medium, image receiving medium, or the like), and this term includes various types of media, of all materials and sizes, such as continuous paper, cut paper, sealed paper, resin sheets, such as OHP sheets, film, cloth, and other materials. In the present specification, the term "printing" indicates the concept of forming images in a broad sense, including text.

The movement device (conveyance device) for causing the recording medium and the recording head move relative to each other may include a mode in which the recording medium conveyed with respect to a stationary (fixed) recording head, or a mode in which a recording head is moved with respect to a stationary recording medium, or a mode in which both the recording head and the recording medium are moved.

According to the present invention, the nozzle supply passages from the pressure chambers to the nozzles are formed to different shapes in accordance with distance of the flow passages from the pressure chamber to the nozzle, and therein respective values of the acoustic resistance and the acoustic inertance are made to be approximately uniform, so it is possible to reduce gaps of discharge performances (droplet volume, discharge speed, discharge direction, and the like) between nozzles.

Moreover, according to a further mode of the present invention, the supply side supply passages from the common flow passage to the pressure chambers are formed to different shapes in accordance with distance of the flow passages from the common flow passage to the pressure chamber, and therein respective values of the acoustic resistance and the acoustic inertance are made to be approximately uniform, so it is possible to reduce gaps of discharge performances while also reducing gaps of supply characteristics to the pressure chambers.

BRIEF DESCRIPTION OF THE DRAWINGS

FIG. 3 is a table showing examples of the approximate dimensions of respective layers in the inkjet recording head illustrated in FIG. 2;

FIG. 5A is a diagram showing an example of circular tubes as the first nozzle supply passage 71, and FIG. 5B is a diagram showing an example of circular tubes as the second nozzle supply passage 72;

FIG. 6 is a table showing an example of the shape of the circular tube shown in FIG. 5A;

DETAILED DESCRIPTION OF THE PREFERRED EMBODIMENTS

Below, a preferred embodiment of the present invention is described with reference to the accompanying drawings.

Figure 1A:
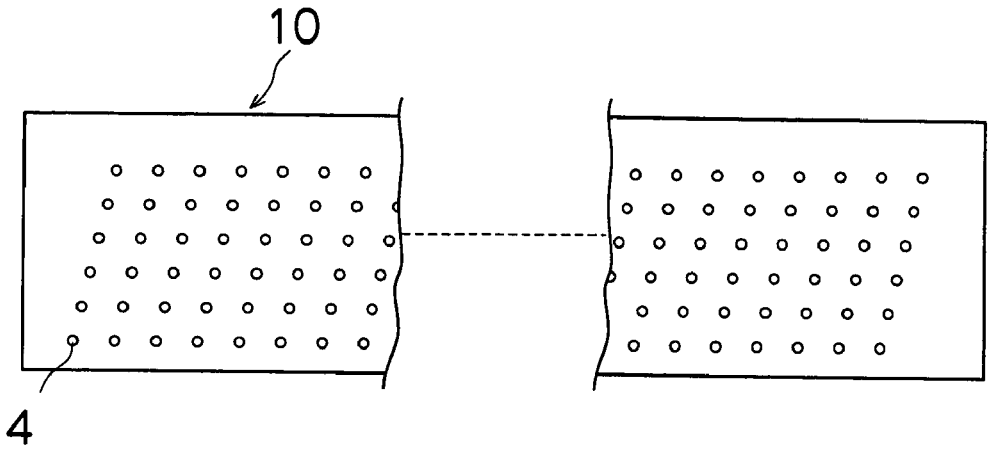
FIG. 1A is a plan perspective view showing the composition of an inkjet recording head forming a first embodiment of the present invention.

FIG. 1A is a plan perspective view showing the composition of an inkjet recording head forming a first embodiment of the present invention. As shown in the diagram, the inkjet recording head 10 is a full line type head having rows of nozzles wherein a plurality of nozzles 4 for discharging ink are arranged along a length corresponding to the full width of a recording medium, in a direction approximately orthogonal to the direction of conveyance of the recording medium (not illustrated). The nozzles 4 are arranged in lattice fashion, in accordance with a prescribed arrangement pattern in the column direction following to a long side of the head and in an oblique row direction that is not orthogonal to the long side and has a prescribed angle θ with respect to this longitudinal direction. In this way, high density of the apparent nozzle pitch projected to align in a long side of the head can be achieved, by means of a structure wherein nozzles 4 are arranged in a staggered matrix arrangement.

Figure 1B:
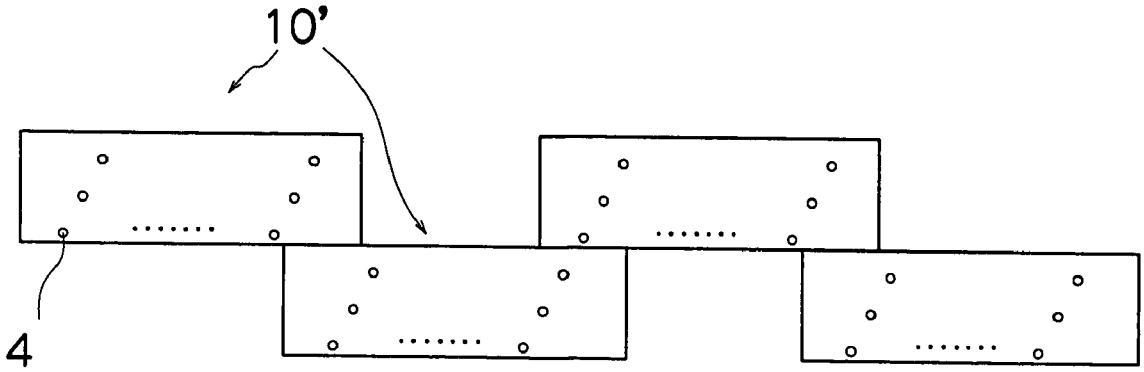
FIG. 1B is a plan view perspective diagram showing a further example of the structure of an inkjet recording head.

Furthermore, as shown in FIG. 1B, it is also possible to compose a full line type head having nozzle rows of a length corresponding to the full width of the recording medium, by mutually joining up short head units 10', wherein a plurality of nozzles 4 are arranged in a two-dimensional fashion, in a staggered arrangement.

Figure 2:
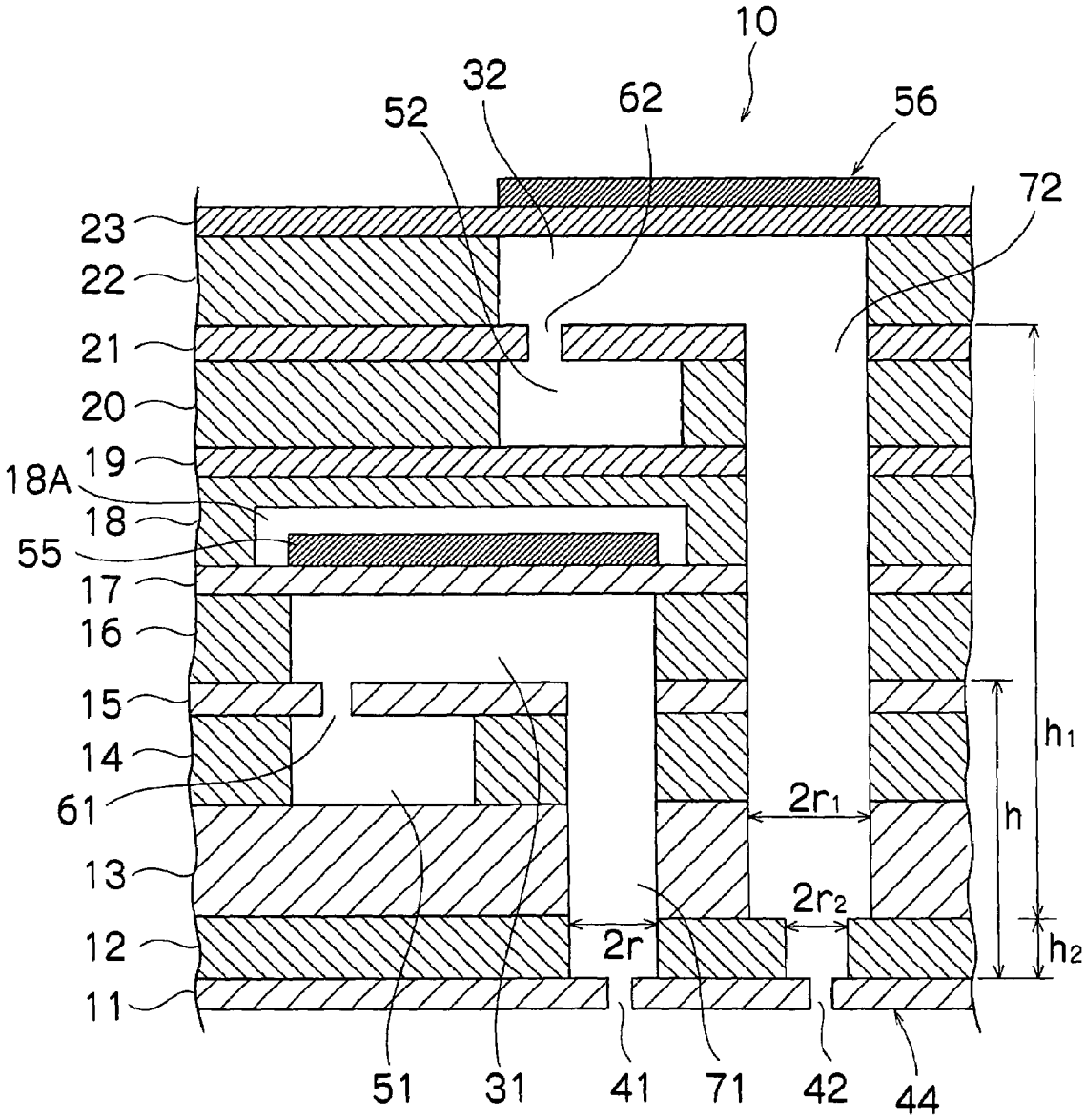
FIG. 2 is a principal cross-sectional view showing the composition of an inkjet recording head according to a first embodiment of the present invention.

FIG. 2 is a principal cross-sectional view showing the composition of an inkjet recording head according to a first embodiment of the present invention. As this diagram shows, the inkjet recording head 10 is manufactured by laminating and bonding a plurality of plate members (11–23), and has a structure wherein, a first pressure chamber 31 and a second pressure chamber 32 are formed internally, in a layered fashion in the direction of lamination (the vertical direction in FIG. 2).

Since the head is formed in a layered fashion by means of a plurality of plate members in this way, then the rigidity of the head is increased and hence warping thereof in the longitudinal direction can be suppressed.

A first nozzle 41 connected to the first pressure chamber 31 and a second nozzle 42 connected to the second pressure chamber 32 are formed in a nozzle plate 11 which is the lower face of the head. As shown in the diagram, the first pressure chamber 31 and the second pressure chamber 32 are disposed in a three-dimensional fashion, in such a manner that they are partially overlapping when viewed from the ink discharge face (nozzle face 44). High density positioning of the nozzles can be achieved by arranging nozzles having the structure shown in FIG. 2, in a line fashion or in a matrix fashion.

Moreover, a first common flow passage 51 for supplying ink to the first pressure chambers 31 in the lower level and a second common flow passage 52 for supplying ink to the second pressure chambers 32 in the upper level are provided inside the head, and the first common flow passage 51 and the second common flow passage 52 are disposed in respectively different layers, in accordance with the respective pressure chambers (31, 32), as shown in the diagram. The first common flow passage 51 and the second common flow passage 52 are connected to an ink bottle (main tank) or a subsidiary tank (auxiliary tank), which are not illustrated, forming ink supply sources.

In FIG. 2, symbol 55 denotes a first pressure element for applying ink discharge energy to a first pressure chamber 31, and symbol 56 denotes a second pressure element for applying ink discharge energy to a second pressure chamber 32.

The first pressure chamber 31 is connected to the first common flow passage 51 by means of a first supply side supply path 61, and furthermore, it is also connected to the first nozzle 41 forming an ink discharge port, by means of a first nozzle supply passage 71. Similarly, the second pressure chamber 32 is connected to the second common flow passage 52 by means of a second supply side supply path 62, and furthermore, it is also connected to the second nozzle 42 forming an ink discharge port, by means of a second nozzle supply passage 72. As stated previously, the first nozzle 41 and the second nozzle 42 are both formed in the same nozzle plate 11, and the distance from the first pressure chamber 31 to the first nozzle 41 (the length of the first nozzle supply passage 71) is different to the distance from the second pressure chamber 32 to the second nozzle 42 (the length of the second nozzle supply passage 72).

Although described in detail hereinafter, in the present embodiment, the flow systems of the first nozzle supply passage 71 and the second nozzle supply passage 72 are designed in such a manner that the ink discharge performances of the respective nozzles (41, 42) corresponding to the two pressure chambers (31, 32) disposed in a layered structure as described above, are approximately equal.

In the present example, the first nozzle supply passage 71 is a uniform round cylinder of radius r and length h. The second nozzle supply passage 72 has a structure combining two circular tubes of different radii. More specifically, the second nozzle supply passage 72 combines, from the side nearest to the second pressure chamber 32, a circular tube of radius $r_1$ and length h1 (called the "wide tube"), and a circular tube of radius $r_2$ ($<r_1$) and length $h_2$ (called the "narrow tube"), these tubes being connected in such a manner that these central axes thereof mutually coinciding. If a flow passage is formed by combining circular tubes of different radii in this manner, the number of stagnant points within the nozzle supply passage can be reduced, by situating the tubes in such a manner that the radius becomes smaller sequentially from the side adjacent to the pressure chamber, so bubble elimination properties and refilling properties are improved.

Desirably, an inkjet recording head 10 having this structure is fabricated by bonding a plurality of plate members (11–23) including a flow passage plate comprising a thin plate made of stainless steel, or the like, formed with holes or grooves, by means of etching, or the like. Moreover, in this case, circular tubes of different radii are constituted by different flow passage plates. In this way, since the holes in any one flow passage plate are of approximately uniform radius, processing can be easier compared to a case where holes of different radii are formed (processed by etching, or the like) in the same plate.

In the example in FIG. 2, layers are formed from the bottom in the following sequence: a nozzle plate 11, a first nozzle supply passage plate 12, a second nozzle supply passage plate 13, a first common flow passage plate 14, a first common flow passage supply passage plate 15, a first pressure chamber plate 16, a first vibration plate 17, a piezoelectric element avoiding plate 18, a third nozzle supply passage plate 19, a second common flow passage plate 20, a second common flow passage supply plate 21, a second pressure chamber plate 22, and a second vibration plate 23.

Through the nozzle plate 11, first nozzle 41 and a second nozzle 42 forming ink discharge ports are pierced. A "nozzle" is the final aperture portion from which liquid is discharged. Desirably, the nozzle size is designed to a diameter of approximately several ten μm, and to a length of several ten μm. The first nozzle supply passage plate 12 is a member constituting a portion of the first nozzle supply passage 71 and a narrow tube of the second nozzle supply passage 72. The second nozzle supply passage plate 13 is a member constituting a portion of the first nozzle supply passage 71 and a wide tube path of the second nozzle supply passage 72. The first common flow passage plate 14 is a member constituting a wall of the first common flow passage 51, a portion of the first nozzle supply passage 71, and a portion of the wide tube of the second nozzle supply passage 72. The first common flow passage plate 15 is a member constituting a first supply side supply passage 61, a portion of the first nozzle supply passage 71, and a portion of the wide tube of the second nozzle supply passage 72. The first pressure chamber plate 16 is a member constituting a wall of the first pressure chamber 31, and a portion of the wide tube of the second nozzle supply passage 72. The first vibration plate 17 seals the upper face of the first pressure chamber 31 (forming a ceiling face), and furthermore, it is a member constituting a portion of the wide tube path of a second nozzle supply path. Moreover, a first piezoelectric element 55 is fixed to the first vibration plate 17, in a position corresponding to the first pressure chamber 31.

In the piezoelectric element, an electrode (not illustrated) is formed and the electrode is connected to a driving circuit (not illustrated), by means of wiring (not illustrated). The piezoelectric element can be driven by means of a driving circuit.

The piezoelectric element avoiding plate 18 has a recess section 18A for ensuring a space in which the first piezoelectric element 55 is disposed, and it allows lamination of further layers above the first piezoelectric element 55. Moreover, the piezoelectric element avoiding plate 18 constitutes a portion of the wide tube of the second nozzle supply passage 72.

The third nozzle supply passage plate 19 is a member constituting one portion of the wide tube of the second nozzle supply passage 72. The second common flow passage plate 20 is a member constituting a wall of the second common flow passage 52, and a portion of the wide tube of the second nozzle supply passage 72. The second common flow passage supply plate 21 is a member constituting a second supply side supply passage 62, and a portion of the wide tube of the second nozzle supply passage 72. The second pressure chamber plate 22 is a member constituting a wall of the second pressure chamber 32. The second vibration plate 23 is a member sealing the upper face of the second pressure chamber 32 (forming a ceiling face), and a second piezoelectric element 56 is fixed to the upper face of the second vibration plate 23 in a position corresponding to the second pressure chamber 32.

When the first piezoelectric element 55 is driven, the volume of the first pressure chamber 31 changes, and an ink droplet is discharged from the first nozzle 41 by means of change in pressure caused by this deformation. Similarly, by driving the second piezoelectric element 56, an ink droplet is discharged from the second nozzle 42. It is possible to record a prescribed image by selectively driving the piezoelectric elements corresponding to the nozzles used in accordance with the image signal that is to be recorded.

In the present example, the size of the first pressure chamber 31 and the size of the second pressure chamber 32 are designed to similar dimensions, and the size of the first common flow passage 51 and the size of the second common flow passage 52 are also designed to similar dimensions. Furthermore, the diameter of the first supply side supply passage 61 and the diameter of the second supply side supply passage 62 are also designed to similar dimensions, and moreover, the diameter of the first nozzle 41 and the diameter of the second nozzle 42 are also designed to similar dimensions.

Figure 4A:
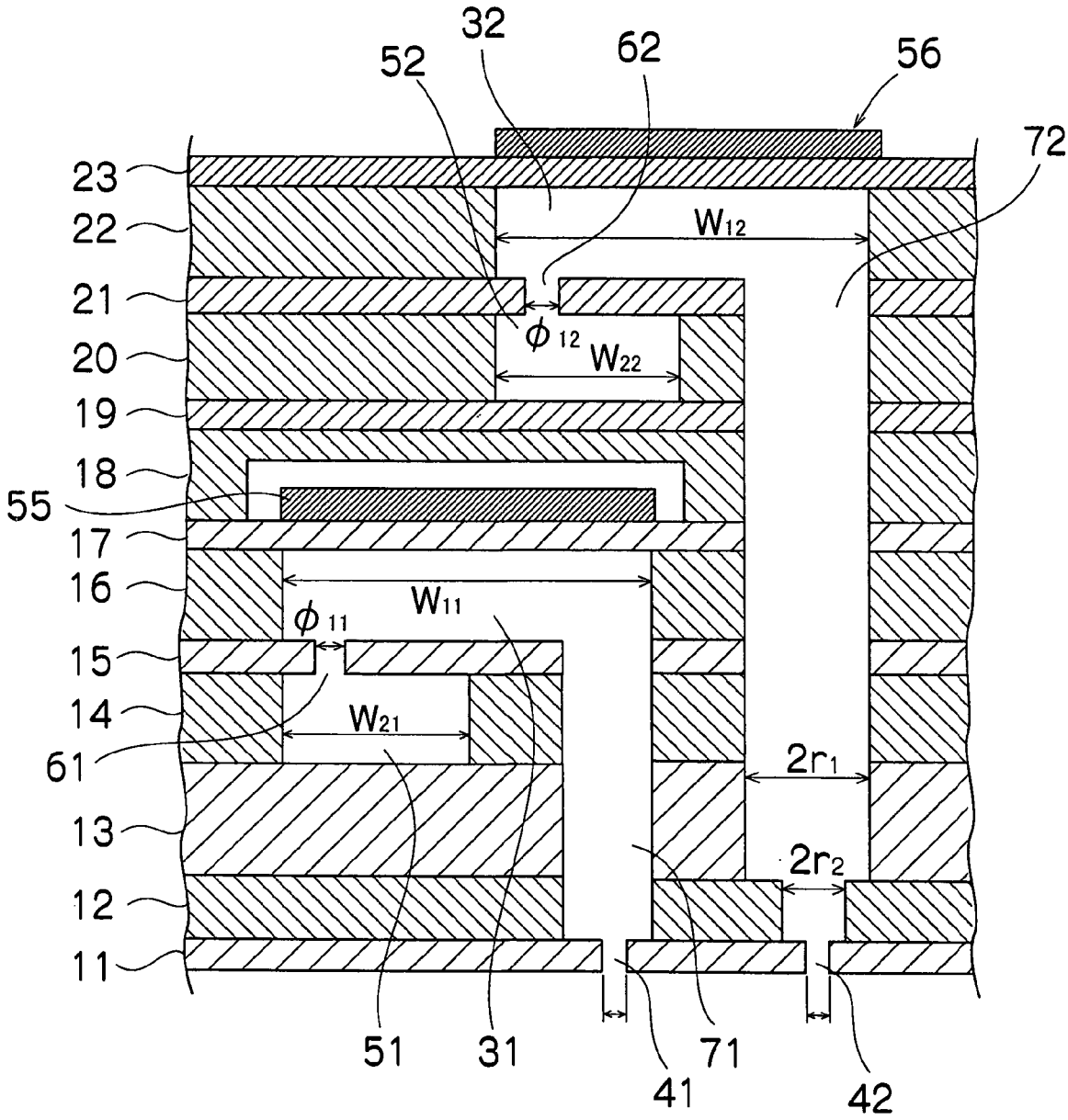
FIG. 4A is a principal cross-sectional view of an inkjet recording head showing the location of the dimensions corresponding to FIG. 3.

FIG. 3 shows a table indicating an example of the approximate dimensions of each layer in order to achieve a head which discharges ink droplets of several picoliters. In FIG. 3, the size of the pressure chamber means the width dimensions $W_{11}$, $W_{12}$ of the cross-sectional shape of each of the pressure chambers (31, 32), as shown in FIG. 4A. Furthermore, the supply flow passage in FIG. 3 means the circular tubular diameter $\Phi_{11}$, $\Phi_{12}$ of the respective supply side supply passages (61, 62), as shown in FIG. 4A, and the size of the common flow passage in FIG. 3 indicates the width dimensions $W_{21}$, $W_{22}$ of the cross-sectional shape of each of the common flow passages (51, 52), as shown in FIG. 4A.

Figure 4B:
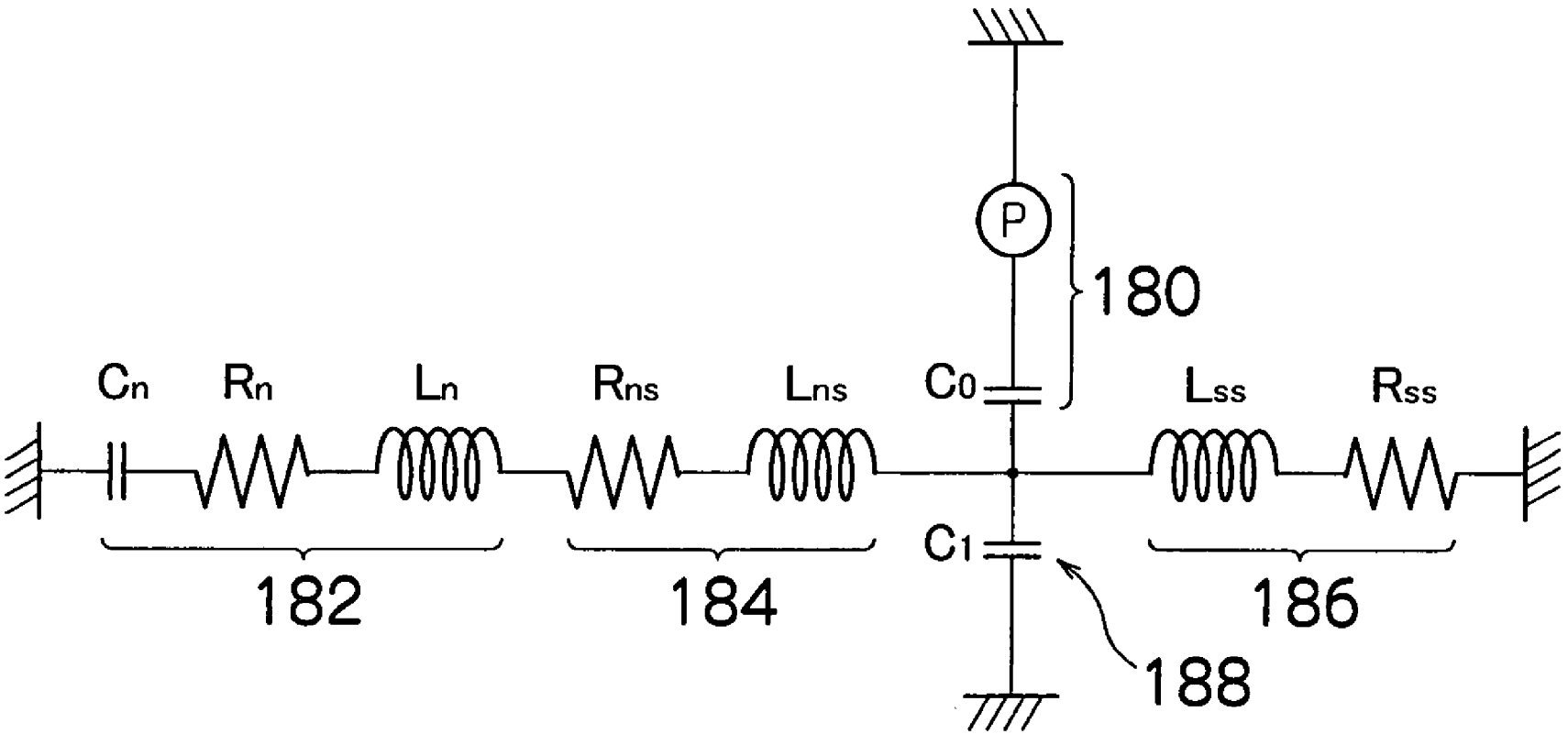
FIG. 4B is an equivalent circuit diagram showing an acoustic model of passage system corresponding to a single pressure chamber.

In the inkjet recording head 10 explained in FIG. 2, the acoustic model showing a pressure chamber (for example, the first pressure chamber 31), a nozzle supply passage (symbol 71) connecting the chamber, a nozzle (symbol 41), a supply side supply passage (symbol 61), a piezoelectric element (symbol 55), and a vibration plate (symbol 17), is FIG. 4B.

Additionally, various symbols in the figure are defined as follow. "P" is shown as the pressure placed on a piezoelectric element equally. "$C_0$" is shown as the acoustic compliance based on the elastic deformation comprising the vibration plate and the piezoelectric element. "$C_n$" is shown as the acoustic compliance of nozzle meniscus. "$R_n$" is shown as the acoustic resistance of nozzle, and "$L_n$" is shown as the acoustic inertance of nozzle supply passage, "$R_{ns}$" is shown as the acoustic resistance of nozzle supply passage, "$L_{ns}$" is shown as the acoustic inertance of nozzle side supply passage, differently. "$L_{ss}$" is shown as the acoustic inertance of supply side supply passage, "$R_{ss}$" is shown as the acoustic resistance of supply side supply passage, and "$C_1$" is shown as the acoustic compliance base on bulk modulus of ink in pressure chamber.

In the present embodiment, the cross-sectional area and the length of the tubular sections of the first nozzle supply passage 71, explained in FIG. 2, connecting the first pressure chamber 31 and the first nozzle 41, and the second nozzle supply passage 72 connecting the second pressure chamber 32 and the second nozzle 42, are determined in such a manner that the acoustic resistance and the acoustic inertance of each are equal.

(Method for Designing the First Nozzle Supply Passage 71 and the Second Nozzle Supply Passage 72)

Here, the method for designing the first nozzle supply passage 71 and the second nozzle supply passage 72 are described. In general, the acoustic resistance R (Pa·s/m$^3$) and the acoustic inertance L (kg/m$^4$) of a circular tube are respectively given by the following equations.

(Formula 1)

$$\text{Acoustic resistance } R=8\pi\cdot\mu\cdot h/S^2\propto h/S^2 \quad (1)$$

(Formula 2)

$$\text{Acoustic inertance } L=\rho\cdot h/S\propto h/S \quad (2)$$

Here, μ: viscosity index of the fluid (Pa·s), r: density of the fluid (kg/m$^3$), h: length of circular tube, S: cross-sectional area of circular tube (m$^2$).

As described above, the first nozzle supply passage 71 is a circular tube of radius r, and the second nozzle supply passage 72 is a circular tube formed by a combination of circular tubes of radii $r_1$ and $r_2$.

The conditions for matching the acoustic resistance and the acoustic inertance in these circular tubes of different shapes are now to be considered. More specifically, the conditions for matching the acoustic resistance and the acoustic inertance shall be considered in respect of a circular tube (as shown in FIG. 5A) of length h and radius r (uniform radius), and a circular tube (as shown in FIG. 5B) formed by a combination of two circular tubes of radius $r_1$ and length $h_1$, and radius $r_2$ and length $h_2$.

From formulas (1) and (2) above, the matching conditions are:

(Formula 3)

$$L=\frac{h}{S}=\frac{h_1}{S_1}+\frac{h_2}{S_2} \quad (3)$$

(Formula 4)

$$R=\frac{h}{S^2}=\frac{h_1}{S_1^2}=\frac{h_2}{S_2^2} \quad (4)$$

Consequently, provided that a combination which satisfies the formulas (3) and (4) is adopted, then the acoustic resistance and acoustic inertance will be matching, even if there is a difference in the shape of the circular tubes in FIGS. 5A and 5B.

Moreover, if the cross-sectional areas $S_1$ and $S_2$ are found from the formulas (3) and (4), then the following equation is obtained.

(Formula 5)

$$S_1=\frac{h_1\pm\sqrt{h_1^2-4\cdot(L-S_2\cdot R)\cdot h_1\cdot S_2}}{2\cdot(L-S_2\cdot R)} \quad (5)$$

(Formula 6)

$$h_2=\frac{S_2^2\cdot(L-S_1\cdot R)}{S_2-S_1} \quad (6)$$

CALCULATION EXAMPLE 1

The shape of a circular tube is illustrated in the table in FIG. 5A, and the radius $r_1$ of the wide tube and the length $h_2$ of the narrow tube are calculated, when the radius $r_2$ of the narrow tube of the circular tube as shown in FIG. 5B, is taken to be 50 μm, and the length h1 of the wide tube of the circular tube in FIG. 5B is varied within the range of 520–1200 μm. The calculation example derives the cross-sectional area $S_1$ of the wide tube and the length $h_2$ of the narrow tube, using formulas (5) and (6), and then determines the radius $r_1$ from the cross-sectional area $S_1$.

Figures 7, 8:
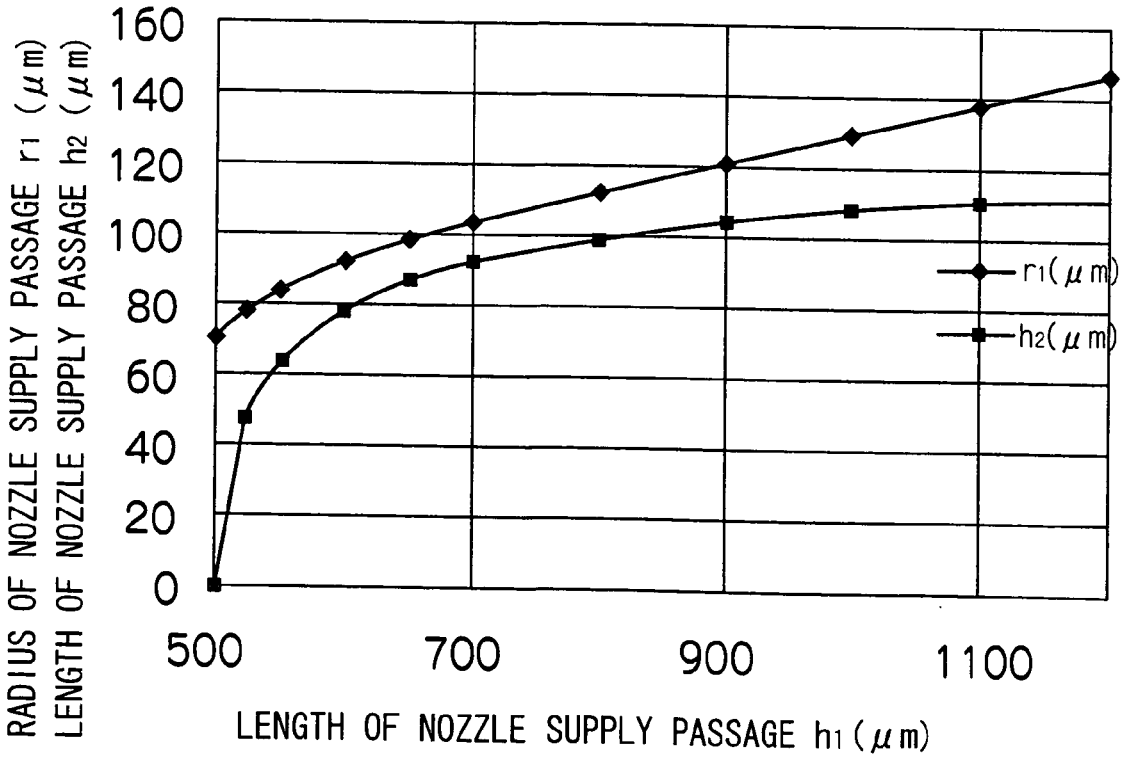
FIG. 7 is a table showing the results of a calculation example relating to the shape of the circular tube shown in FIG. 5B.
FIG. 8 is a graph showing the relationship between the length $h_1$ and radius $r_1$ of the nozzle supply passage in the large diameter portion, and the length $h_2$ of the nozzle supply passage in the small diameter portion, as obtained from the results of the calculation in FIG. 7.

Moreover, since this is a quadratic equation, two solutions for $S_1$ and $h_2$ are found, but, since the tube length will become a negative value if $h_2<0$, which is an unrealistic condition, then the solution containing $h_2>0$ is used. FIG. 7 shows the calculational results relating to the shape of the circular tube in FIG. 5B.

From the calculational results shown in FIG. 7, the relationship between the nozzle supply passage length $h_1$ and the radius $r_1$ in the large diameter portion of the circular tube in FIG. 5B and the nozzle supply passage length $h_2$ in the narrow diameter portion thereof, is as illustrated in FIG. 8.

Therefore, taking the circular tube in FIG. 5A shown in FIG. 5 to correspond to the first nozzle supply passage 71 and the circular tube in FIG. 5B to correspond to the second nozzle supply passage 72, for example, then if the first nozzle supply passage 71 is taken to be a circular tube of dimensions h=500 μm and r=70 μm, and the second nozzle supply passage 72 is taken to be a circular tube of dimensions $h_1$=1000 μm, $r_1$=131 μm, $h_2$=109 μm, and $r_2$=50 μm, so that these two nozzle supply passages (71, 72) will have the same acoustic resistance and acoustic inertance values.

CALCULATION EXAMPLE 2

Moreover, as a further calculation example, the radius $r_1$ of the wide tube and the length $h_2$ of the narrow tube are calculated, when the radius $r_2$ of the narrow tube of the circular tube in FIG. 5B is varied within a range of 20–69.99 μm, with respect to a circular tube in FIG. 5A of the same shape as the circular tube in FIG. 5A in the calculation example 1. The calculation example derives the cross-sectional area $S_1$ of the wide tube and the length $h_2$ of the narrow tube, using formulas (5) and (6), and then determines the radius $r_1$ from the cross-sectional area $S_1$.

Figures 9, 10:
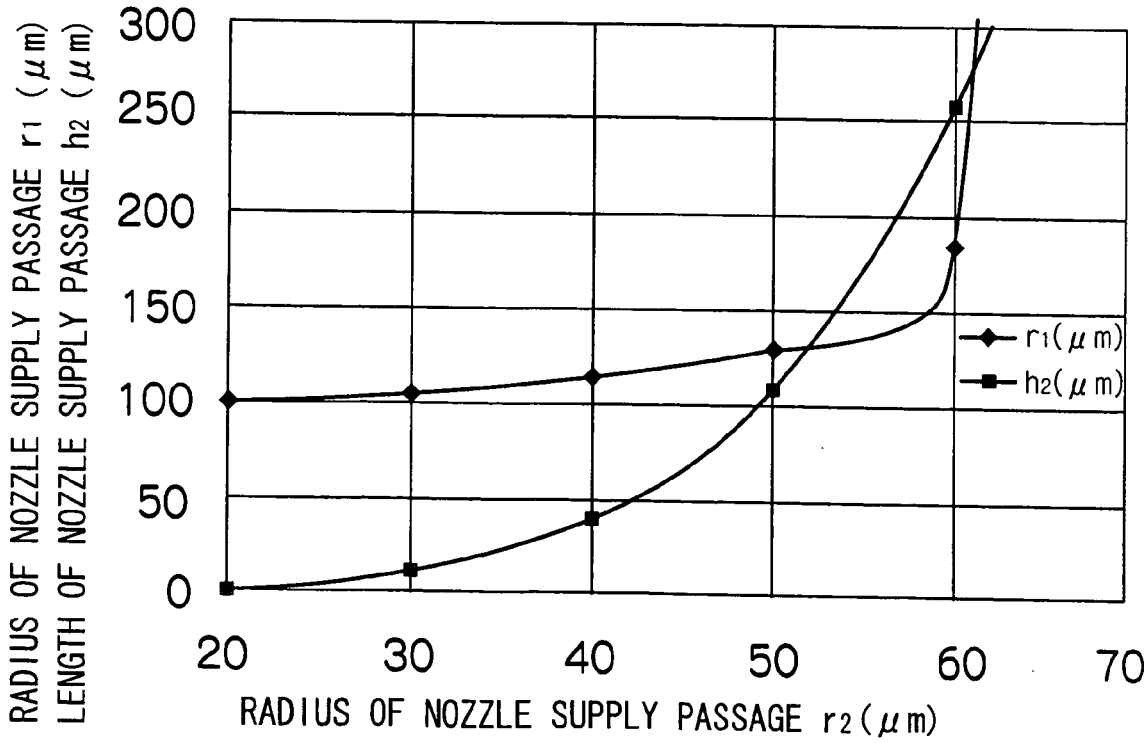
FIG. 9 is a table showing the results of a further calculation example relating to the shape of the circular tube shown in FIG. 5B.
FIG. 10 is a graph showing the relationship between the radius $r_2$ and length $h_2$ of the nozzle supply passage section of small diameter, and the radius $r_1$ of the nozzle supply passage of large diameter, as obtained from the results of the calculation in FIG. 9.

Moreover, since this is a quadratic equation, two solutions for $S_1$ and $h_2$ are found, but, since the tube length will become a negative value if $h_2<0$, which is an unrealistic condition, then the solution containing $h_2>0$ is used. FIG. 9 shows the calculational results relating to the shape of the circular tube in FIG. 5B.

From the calculational results shown in FIG. 9, the relationship between the radius $r_2$ and length $h_2$ of the nozzle supply passage section of small diameter, and the radius $r_1$ of the nozzle supply passage of large diameter, will be as shown in FIG. 10.

Therefore, taking the circular tube in FIG. 5A to correspond to the first nozzle supply passage 71 and the circular tube in FIG. 5B to correspond to the second nozzle supply passage 72, for example, then if the first nozzle supply passage is taken to be a circular tube of dimensions h=500 μm and r=70 μm, and the second nozzle supply passage 72 is taken to be a circular tube of dimensions $h_1$=1000 μm, $r_1$=131 μm, $h_2$=109 μm, and $r_2$=50 μm, then these two nozzle supply passages (71, 72) will have the same acoustic resistance and acoustic inertance.

By designing the first nozzle supply passage 71 and the second nozzle supply passage 72 in such a manner that the acoustic resistance and the acoustic inertance thereof are the same, it is possible to ensure that the first nozzle 41 and the second nozzle 42 have equivalent discharge performance. In this way, by aligning the discharge performance at each nozzle, it is possible to achieve images of high quality.

In the foregoing embodiment, the supply passages for supplying ink respectively to the first pressure chamber and the second pressure chamber in different layers were described as having the same shape, despite the fact that they are in different layers. However, in implementing the present invention, it is not necessary for the supply passages to be of the same shape. If it is not possible to achieve a composition wherein the flow shapes of the supply passages are equivalent, then similarly to the case of the nozzle supply passages, a structure combining two or more circular tubes of different radii may be adopted in at least one of the supply passages, the cross-sectional area and the length thereof being designed in such a manner that the acoustic resistance and the acoustic inertance are the same in each of the respective supply passages.

(Further Embodiments)

Figures 11, 12:
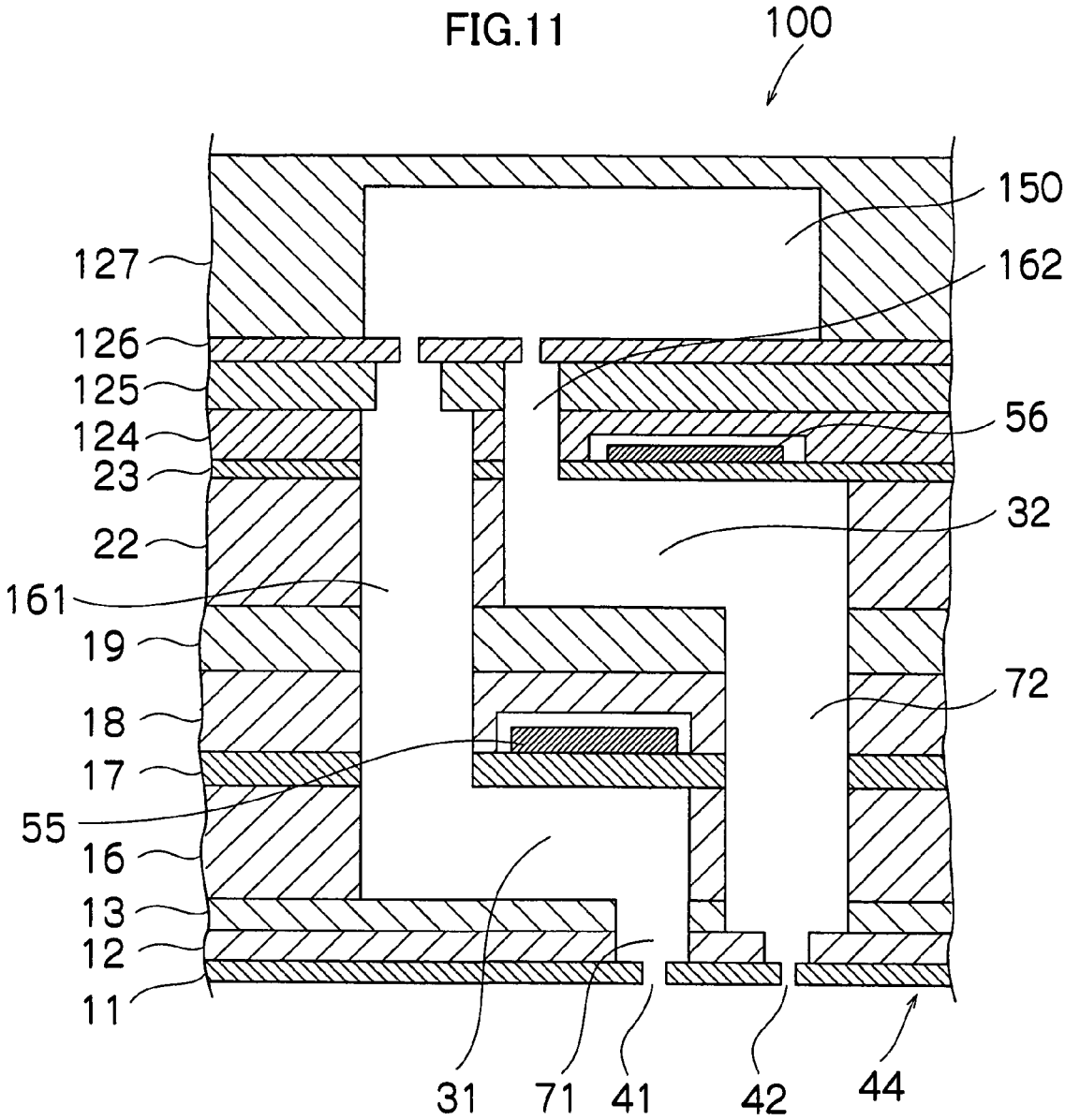
FIG. 11 is a principal cross-sectional view showing the composition of an inkjet recording head relating to a second embodiment of the present invention.
FIG. 12 is a table showing one example of driving conditions of a piezoelectric element.

FIG. 11 is a principal cross-sectional view showing the composition of an inkjet recording head relating to a second embodiment of the present invention. In this diagram, items which are the same as or similar to those in FIG. 2 are labeled with the same reference symbols and description thereof is omitted here.

As shown in FIG. 11, this inkjet recording head 100 has a structure wherein a first pressure chamber 31 and a second pressure chamber 32 are disposed at different distances from a nozzle plate 11, ink being supplied from the same common flow passage 150 to the respective pressure chambers (31, 32).

More specifically, a common flow passage 150 is provided in the uppermost layer of the head, and the common flow passage 150 is connected to the first pressure chamber 31 via a first supply side supply passage 161 and is connected to the second pressure chamber 32 via a second supply side supply passage 162.

In the present example, the first supply side supply passage 161 which connects the common flow passage 150 and the first pressure chamber 31 has a structure which combines three circular tubes of different radii. On the other hand, the second supply side supply passage 162 which connects the common flow passage 150 and the second pressure chamber 32 has a structure which combines two circular tubes of different radii.

In FIG. 11, symbol 124 denotes a second piezoelectric element avoiding plate which ensures a space for installing a second piezoelectric element 56, and symbols 125 and 126 denote common flow passage supply path plates which form supply side supply passages (161, 162). Moreover, symbol 127 is a common flow passage plate forming the common flow passage 150.

In the inkjet recording head 100 having the composition described above, the distance from the first pressure chamber 31 to the first nozzle 41 (namely, the length of the first nozzle supply passage 71), and the distance from the second pressure chamber 32 to the second nozzle 42 (the length of the second nozzle supply passage 72), are different, and furthermore, the distance from the common flow passage 150 to the first pressure chamber 31 (the length of the first supply side supply passage 161) and the distance from the common flow passage 150 to the second pressure chamber 32 (the length of the second supply side supply passage 162) are different.

As illustrated in FIG. 5 to FIG. 10, the shape of the flow passages are designed in such a manner that the nozzle supply passages (71, 72) respectively have the matching acoustic resistance and acoustic inertance, and furthermore, using a similar technique to this, the shape of the flow passages are designed in such a manner that the supply side supply passages (161, 162) also have matching acoustic resistance and acoustic inertance.

In the present example, the first supply side supply passage 161 which connects the common flow passage 150 and the first pressure chamber 31 has a structure which combines three circular tubes of different radii. On the other hand, the second supply side supply passage 162 which connects the common flow passage 150 and the second pressure chamber 32 has a structure which combines two circular tubes of different radii.

The shape of the flow passages is not limited to this example, and a composition combining two or more tubular paths having different cross-sectional areas in at least one of the flow passages may be adopted, the shape thereof being determined in such a manner that the acoustic resistance and the acoustic inertance are respectively matching.

The first and second embodiments described above are able to equalize discharge performance by controlling the shape of the flow passages.

On the other hand, there is also a mode for achieving uniform discharge performance by controlling the drive waveforms of the piezoelectric elements. This method is described below.

(Controlling the Drive Waveforms of the Piezoelectric Elements)

The drive waveforms of the piezoelectric elements and the operation of it are considered, for set combinations of the shape of the nozzle supply passage from the pressure chamber to the nozzle, and the shape of the nozzle.

(Condition 1)

Shape of nozzle: radius=15 μm, length=30 μm; shape of nozzle supply passage: radius=75 μm, length=500 μm; properties of ink used: viscosity=2 cP (centipoise), density=1000 $kg/m^3$, speed of pressure propagation (speed of sound in the ink)=1500 m/s. Moreover, the driving conditions were taken to be rectangular wave driving as indicated in FIG. 12. FIG. 13 shows the calculational results derived from these conditions.

Figure 13A:
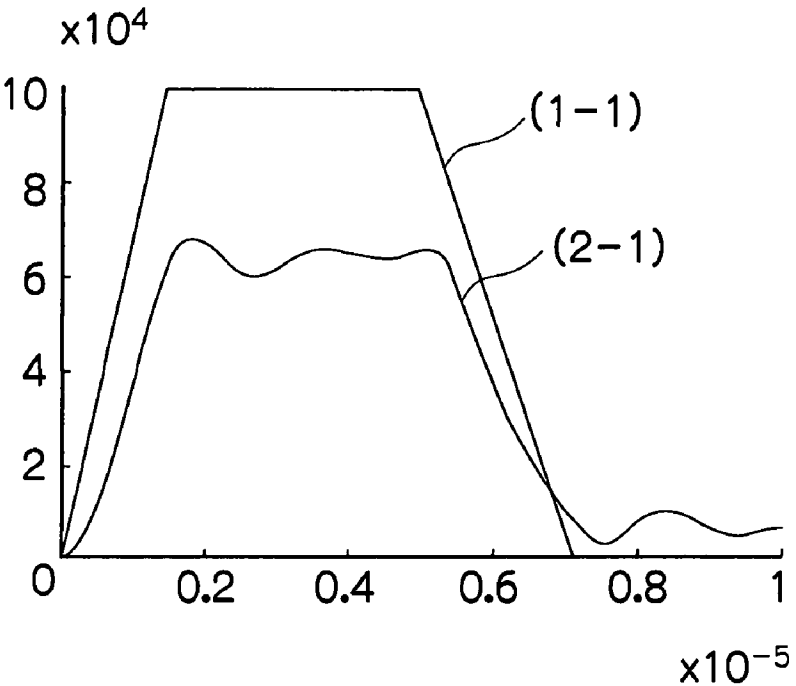
FIG. 13A is a graph showing input conditions according to (Condition 1) and the corresponding variation in pressure inside the nozzle.
Figure 13B:
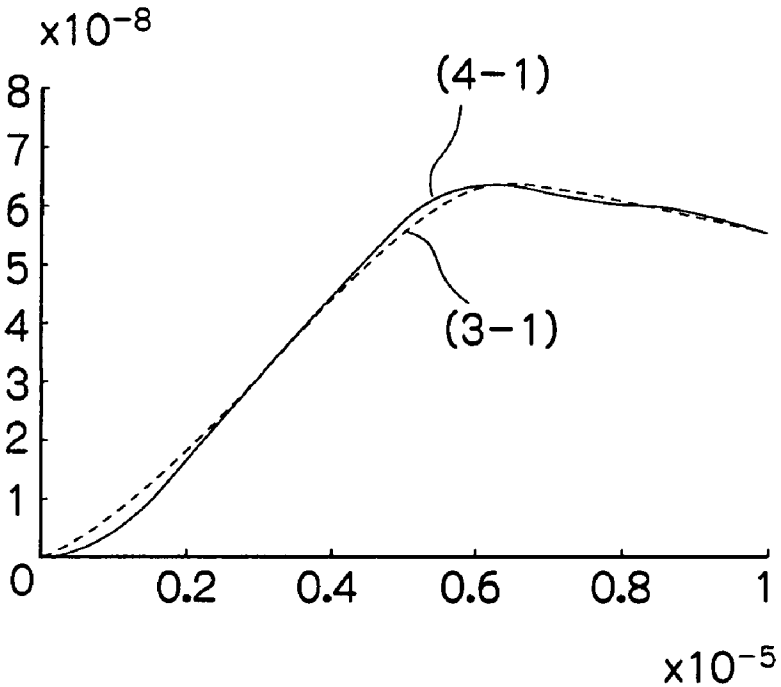
FIG. 13B is a graph showing the respective flow rates in the supply side supply passage and the nozzle, according to (Condition 1)

FIG. 13A is a graph showing the input waveform (1-1) and the pressure variation in the nozzle (2-1). The horizontal axis shows time ($10^{-5}$ s), and the vertical axis shows normalized pressure ($10^4$ Pa). FIG. 13B is a graph showing the flow rate inside the nozzle supply passage (3-1) and the flow rate (4-1) inside the nozzle. The horizontal axis shows time ($10^{-5}$ s), and the vertical axis shows the normalized flow rate ($10^{-8}$ m/s).

(Condition 2)

Only the condition relating to the length of the nozzle supply passage was changed, to 2000 μm, apart from which the other conditions were taken to be the same as those described above (Condition 1). Furthermore, the driving conditions were the same as those in (Condition 1). The calculational results in this case are shown in FIG. 14.

Figure 14A:
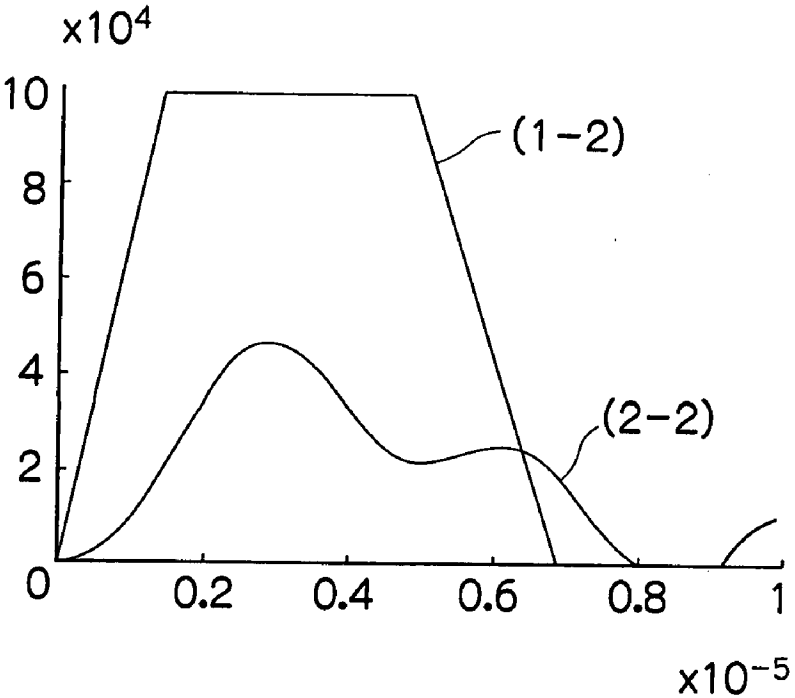
FIG. 14A is a graph showing input conditions according to (Condition 2) and the corresponding variation in pressure inside the nozzle.
Figure 14B:
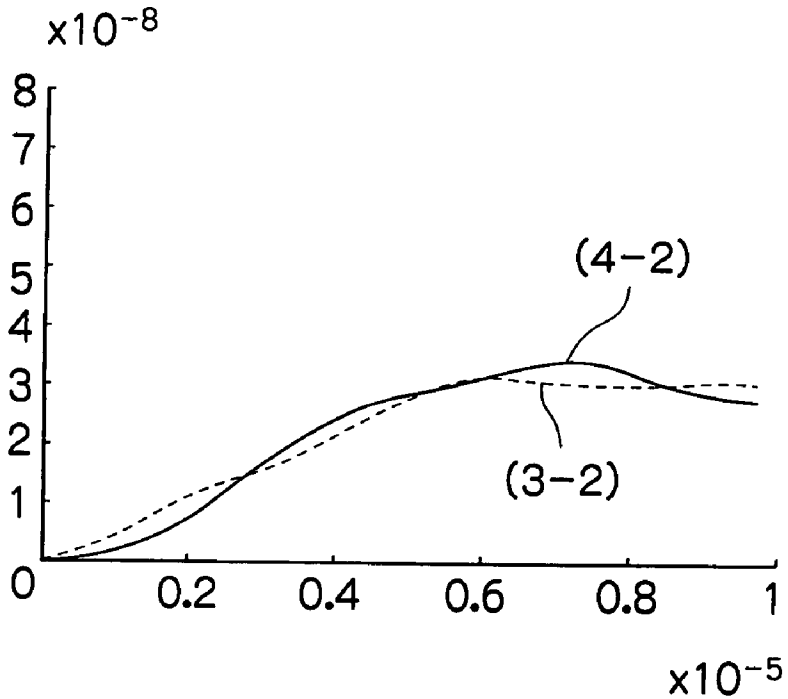
FIG. 14B is a graph showing the respective flow rates in the supply side supply passage and the nozzle, according to (Condition 2)

FIG. 14A is a graph showing the input waveform (1-2) and the pressure variation in the nozzle (2-2). FIG. 14B is a graph showing the flow rate inside the nozzle supply passage (3-2) and the flow rate (4-2) inside the nozzle. In (Condition 2), compared to (Condition 1), by making the supply passage longer, the flow rate at the nozzle declines, and hence it takes a longer time for the flow rate to reach a maximum value (compare and contrast FIG. 13B and FIG. 14B).

(Condition 3)

With respect to the shape of the flow passage and the ink parameters, the length of the nozzle supply passage was set to 2000 μm, apart from which the remaining conditions were taken to be the same as those in (Condition 1). Furthermore, the driving conditions were taken to be 1.8 times the amplitude and 0.9 times the cycle, with respect to (Condition 1). The calculational results in this case are shown in FIG. 15.

Figure 15A:
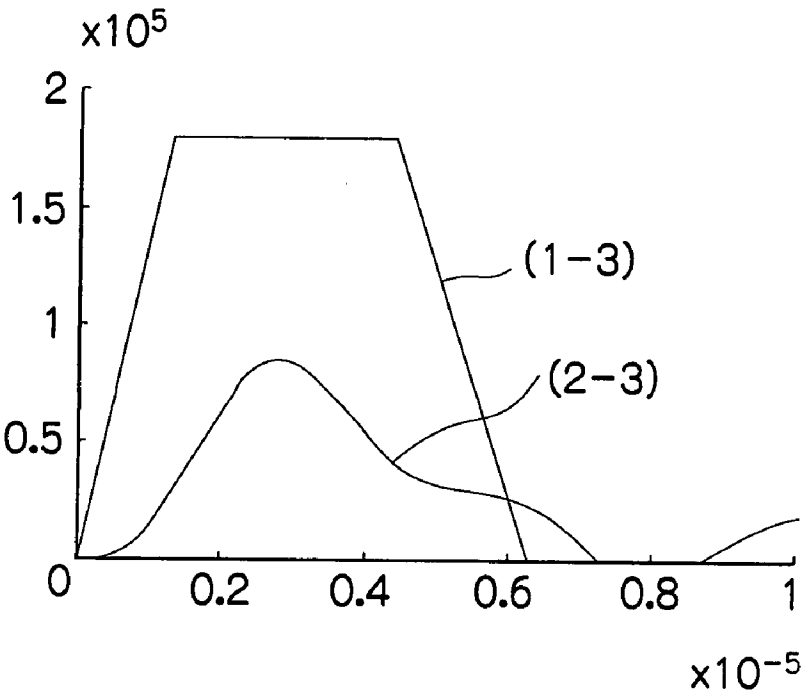
FIG. 15A is a graph showing input conditions according to (Condition 3) and the corresponding variation in pressure inside the nozzle.
Figure 15B:
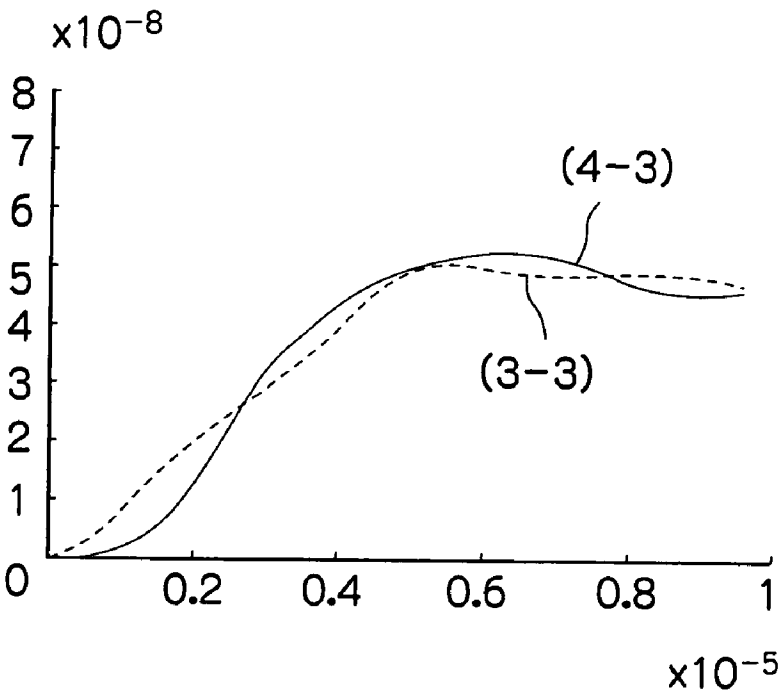
FIG. 15B is a graph showing the respective flow rates in the supply side supply passage and the nozzle, according to (Condition 3)

FIG. 15A is a graph showing the input waveform (1-3) and the pressure variation in the nozzle (2-3). FIG. 15B is a graph showing the flow rate inside the nozzle supply passage (3-3) and the flow rate (4-3) inside the nozzle. As shown in these diagrams, in (Condition 3), by increasing the amplitude of the driving pulse and also increasing the frequency, with respect to (Condition 2), the flow rate in the nozzle, and the time taken for the flow rate to reach a maximum value, are approximately equal to those in (Condition 1) (compare FIG. 13B and FIG. 15B).

In this way, it is possible to equalize discharge performance by means of the drive waveform. For example, by varying the discharge drive waveform for each pressure chamber having a different physical distance from the pressure chamber to the nozzle, the discharge performance of each can be equalized. If the nozzle supply passage is taken to be a tubular passage of uniform cross-sectional area, then desirably, the greater the distance from the pressure chamber to the nozzle, the higher the drive frequency setting and the higher the amplitude setting.

(Combination of Structure and Drive Waveform)

By implementing flow passage design in order to achieve matching acoustic resistance and acoustic inertance values, as described with reference from FIG. 2 to FIG. 10, and furthermore, setting suitable drive waveforms for the respective pressure chambers, it is possible to reduce the differences in discharge performance to an extremely low level.

(General Configuration of an Inkjet Recording Apparatus)

Next, the general configuration of an inkjet recording apparatus according to inkjet recording head 10 or 100 of above embodiments is described.

Figure 16:
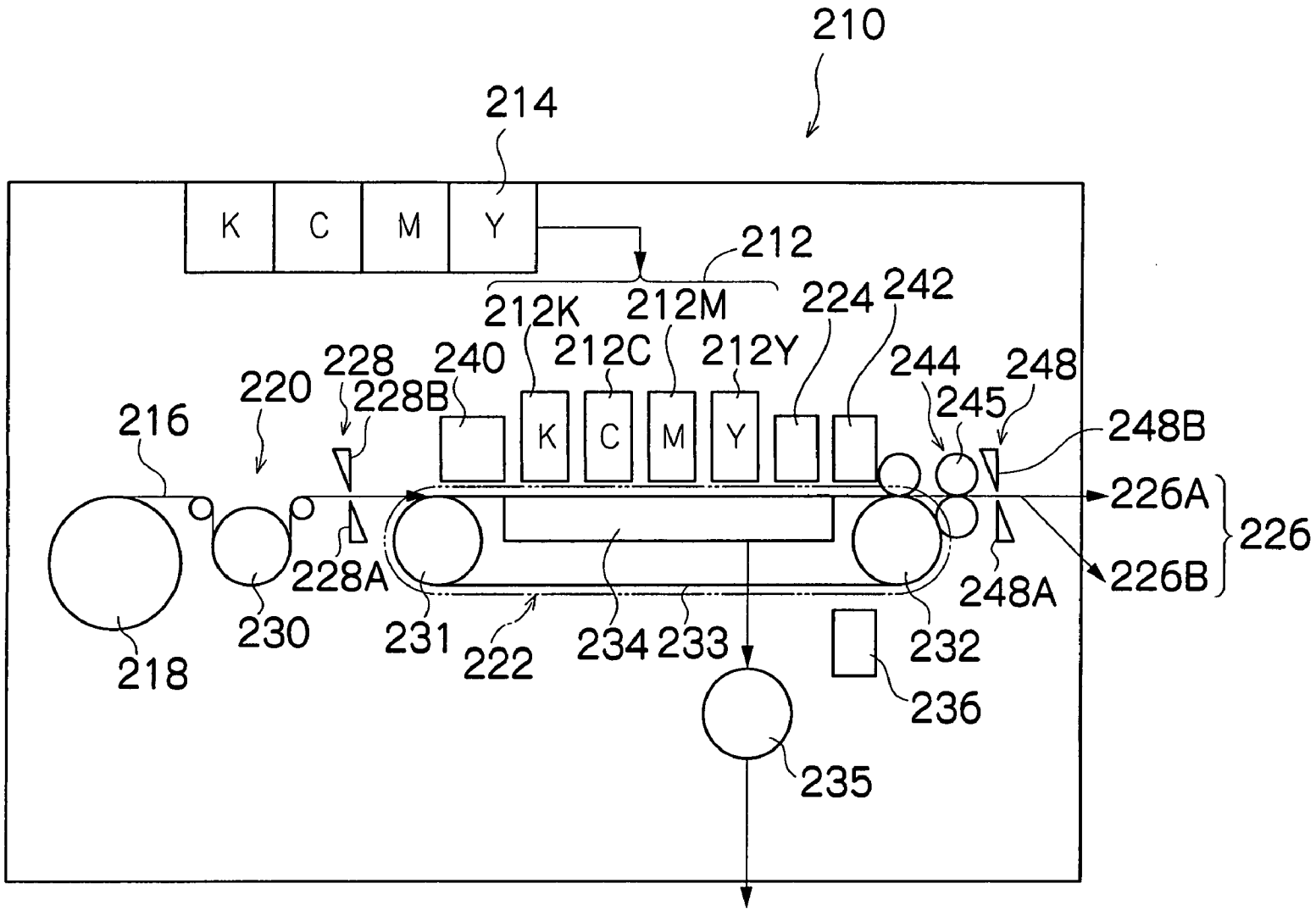
FIG. 16 is a general schematic drawing of an inkjet recording apparatus according to an embodiment of the present invention.

FIG. 16 is a general schematic drawing of an inkjet recording apparatus according to an embodiment of the present invention. As shown in FIG. 16, the inkjet recording apparatus 210 comprises: a printing unit 212 having a plurality of inkjet recording heads (hereinafter referred to as head) 212K, 212C, 212M, and 212Y for ink colors of black (K), cyan (C), magenta (M), and yellow (Y), respectively; an ink storing/loading unit 214 for storing inks to be supplied to those heads 212K, 212C, 212M, and 212Y; a paper supply unit 218 for supplying recording paper 216; a decurling unit 220 for removing curl in the recording paper 216; a suction belt conveyance unit 222 disposed facing the nozzle face (ink-droplet ejection face) of the print unit 212, for conveying the recording paper 216 while keeping the recording paper 216 flat; a print determination unit 224 for reading the printed result produced by the printing unit 212; and a paper output unit 226 for outputting image-printed recording paper (printed matter) to the exterior.

The inkjet recording head 10 or 100 explained in FIG. 1 to 15 is applied as each of inkjet recording heads 212K, 212C, 212M, and 212Y in a printing unit 212.

The ink storing/loading unit 214 has tanks for storing ink with colors corresponding to each of those heads 212K, 212C, 212M, and 212Y, and each tanks are in communication with each of the recording heads 212K, 212C, 212M, and 212Y via a conduit.

In FIG. 16, a single magazine for rolled paper (continuous paper) is shown as an example of the paper supply unit 218; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 216 delivered from the paper supply unit 218 retains curl due to having been loaded in the magazine. In order to remove the curl, heat is applied to the recording paper 216 in the decurling unit 220 by a heating drum 230 in the direction opposite from the curl direction in the magazine. The heating temperature at this time is preferably controlled so that the recording paper 216 has a curl in which the surface on which the print is to be made is slightly round outward.

In the case of the configuration in which roll paper is used, a cutter (first cutter) 228 is provided as shown in FIG. 16, and the continuous paper is cut into a desired size by the cutter 228. The cutter 228 has a stationary blade 228A, whose length is equal to or greater than the width of the conveyor pathway of the recording paper 216, and a round blade 228B, which moves along the stationary blade 228A. The stationary blade 228A is disposed on the reverse side of the printed surface of the recording paper 216, and the round blade 228B is disposed on the printed surface side across the conveyor pathway. When cut paper is used, the cutter 228 is not required.

The decurled and cut recording paper 216 is delivered to the suction belt conveyance unit 222. The suction belt conveyance unit 222 has a configuration in which an endless belt 233 is set around rollers 231 and 232 so that the portion of the endless belt 233 facing at least the nozzle face of the printing unit 212 and the sensor face of the print determination unit 224 forms a horizontal plane (flat plane).

The belt 233 has a width that is greater than the width of the recording paper 216, and a plurality of suction apertures (not shown) are formed on the belt surface. A suction chamber 234 is disposed in a position facing the sensor surface of the print determination unit 224 and the nozzle surface of the printing unit 212 on the interior side of the belt 233, which is set around the rollers 231 and 232, as shown in FIG. 16; and the suction chamber 234 provides suction with a fan 235 to generate a negative pressure, and the recording paper 216 is held on the belt 233 by suction.

Figure 17:
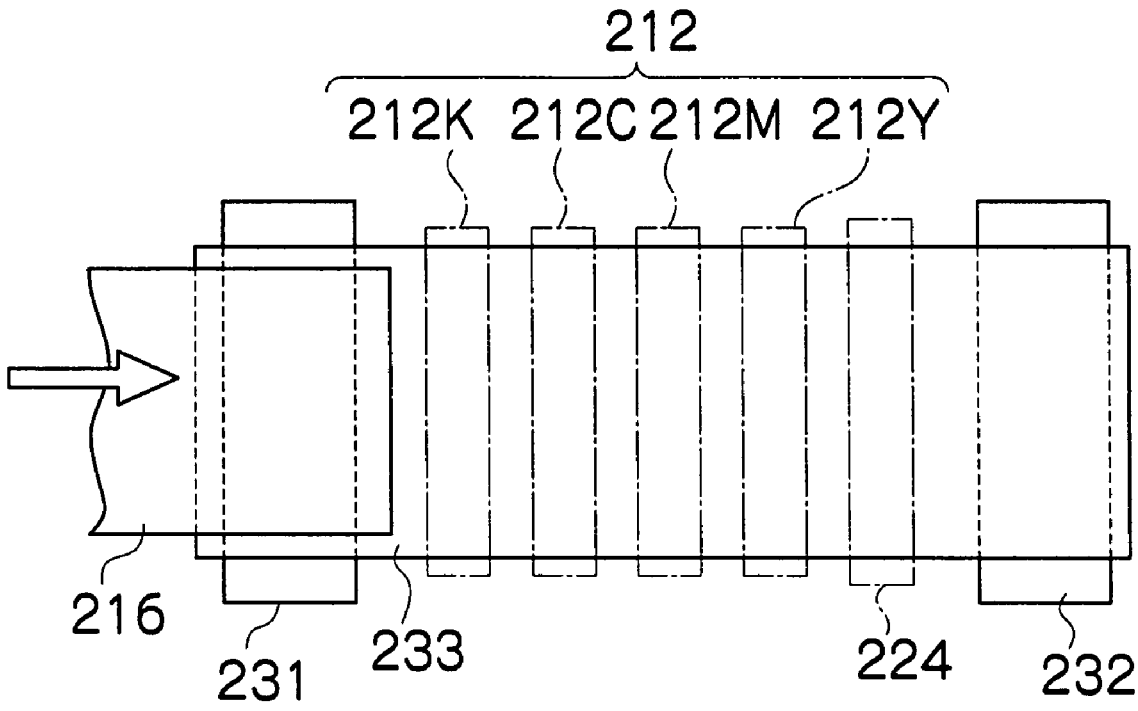
FIG. 17 is a principal plan view showing in the neighborhood print unit of inkjet recording apparatus.

The belt 233 is driven in the clockwise direction in FIG. 16 by the motive force of a motor (not shown) being transmitted to at least one of the rollers 231 and 232, which the belt 233 is set around, and the recording paper 216 held on the belt 233 is conveyed from left to right in FIG. 16 and FIG. 17.

Since ink adheres to the belt 233 when a marginless print job or the like is performed, a belt-cleaning unit 236 is disposed in a predetermined position (a suitable position outside the printing area) on the exterior side of the belt 233. Although the details of the configuration of the belt-cleaning unit 236 are not depicted, examples thereof include a configuration in which the belt 233 is nipped with a cleaning roller such as a brush roller and a water absorbent roller, an air blow configuration in which clean air is blown onto the belt 233, or a combination of these. In the case of the configuration in which the belt 233 is nipped with the cleaning roller, it is preferable to make the line velocity of the cleaning roller different than that of the belt 233 to improve the cleaning effect.

The inkjet recording apparatus 210 can comprise a roller nip conveyance mechanism, in which the recording paper 216 is pinched and conveyed with nip rollers, instead of the suction belt conveyance unit 222. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 240 is disposed on the upstream side of the printing unit 212 in the conveyance pathway formed by the suction belt conveyance unit 222.

The heating fan 240 blows heated air onto the recording paper 216 to heat the recording paper 216 immediately before printing so that the ink deposited on the recording paper 216 dries more easily.

Each of those heads 212K, 212C, 212M, and 212Y in the recording unit 212 is composed of a line head, in which a plurality of ink-droplet nozzles are arranged along a length that exceeds at least one side of the maximum-size recording paper 216 intended for use in the inkjet recording apparatus 210 (as shown in FIG. 17).

The heads 212K, 212C, 212M, and 212Y are arranged in order of black (K), cyan (C), magenta (M), and yellow (Y) from the upstream side along the paper conveyance direction, which is approximately perpendicular to a conveyance direction of the recording paper 216.

A color print can be formed on the recording paper 216 by ejecting the inks from those heads 212K, 212C, 212M, and 212Y, respectively, onto the recording paper 216 while conveying the recording paper 216 with the belt 233.

Thus, with the recording unit 212 in which full-line heads 212K, 212C, 212M, 212Y that cover the entire width of the paper are provided for each ink color, an image can be recorded across the entire surface of the recording paper 216 by performing the action of moving the recording paper 216 and recording unit 212 in relation to each other in the paper conveyance direction (the sub-scanning direction) just once (i.e., with a single sub-scan). High-speed recording is thereby made possible in comparison with a shuttle type head in which the print head reciprocates in the main scanning direction of the recording head, and productivity can be improved.

Although the configuration with the KCMY four standard colors is described in the present embodiment, combinations of the ink colors and the number of colors are not limited to those, and light and/or dark inks can be added as required. For example, a configuration is possible in which inkjet recording heads for ejecting light-colored inks such as light cyan and light magenta are added. Moreover, a configuration is possible in which a single inkjet recording head adapted to record an image in the colors of CMY or KCMY is used instead of the plurality of inkjet recording heads for the respective colors.

As shown in FIG. 16, the print determination unit 224 has an image sensor for capturing an image of the ink-droplet deposition result of the print unit 212, and functions as a device to check for ejection defects such as clogs of the nozzles in the print unit 212 from the ink-droplet deposition results evaluated by the image sensor.

The print determination unit 224 of the present embodiment is configured with at least a line sensor having rows of photoelectric transducing elements with a width that is greater than the ink-droplet ejection width (image recording width) of those heads 212K, 212C, 212M, and 212Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 224 reads a test pattern printed with those heads 212K, 212C, 212M, and 212Y for the respective colors, and the ejection of each head is determined. The ejection determination includes the presence of the ejection, measurement of the dot size, and measurement of the dot deposition position. The details of the ejection determination are described later.

A post-drying unit 242 is disposed following the print determination unit 224. The post-drying unit 242 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 244 is disposed following the post-drying unit 242. The heating/pressurizing unit 244 is a device to control the glossiness of the image surface, and the image surface is pressed with a pressure roller 245 having a predetermined uneven surface shape while the image surface is heated, and the uneven shape is transferred to the image surface.

The printed matter generated in this manner is outputted from the paper output unit 226. The target print (i.e., the result of printing the target image) and the test print are preferably outputted separately. In the inkjet recording apparatus 210, a sorting device (not shown) is provided for switching the outputting pathway in order to sort the printed matter with the target print and the printed matter with the test print, and to send them to paper output units 226A and 226B, respectively. When the target print and the test print are simultaneously formed in parallel on the same large sheet of paper, the test print portion is cut and separated by a cutter (second cutter) 248. The cutter 248 is disposed directly in front of the paper output unit 226, and is used for cutting the test print portion from the target print portion when a test print has been performed in the blank portion of the target print. The structure of the cutter 248 is the same as the first cutter 228 described above, and has a stationary blade 248A and a round blade 248B.

Although not shown in FIG. 16, a sorter for collecting prints according to print orders is provided to the paper output unit 226A for the target prints.

(Combination of Structure and Drive Waveform)

By implementing flow passage design in order to achieve matching acoustic resistance and acoustic inertance values, as described with reference from FIG. 2 to FIG. 10, and furthermore, setting suitable drive waveforms for the respective pressure chambers, it is possible to reduce the differences in discharge performance to an extremely low level.

In the foregoing description, a inkjet recording head based on a so-called piezoelectric method was described as an example, but the present invention may also be applied in a similar manner to a thermal type inkjet recording head, wherein ink droplets are discharged by pressurizing the ink by means of a heater designed to heat the ink and generate bubbles in same. Moreover, the scope of application of the present invention is not limited to an inkjet recording apparatus as described above, and the droplet discharging head according to the present invention may be applied to various types of liquid discharging devices, such as coating devices, for coating a treatment solution, or other liquid, onto a medium, or the like.

What is claimed is:

1. A droplet discharging head, comprising:

a nozzle plate formed with a first nozzle and a second nozzle which eject liquid;

a first pressure chamber which is connected to the first nozzle and is filled with the liquid to be discharged from the first nozzle;

a first piezoelectric element which generates pressure for causing pressure change in the liquid inside the first pressure chamber, and thereby causes a droplet to be discharged from the first nozzle;

a second pressure chamber which is connected to the second nozzle and is filled with the liquid to be discharged from the second nozzle; and a second piezoelectric element which generates pressure for causing pressure change in the liquid inside the second pressure chamber, and thereby causes a droplet to be discharged from the second nozzle, wherein:

if an ejection direction of the liquid which is ejected from the first nozzle and the second nozzle is regarded as a downward direction, the first piezoelectric element is disposed on an upper surface of the first pressure chamber and the second piezoelectric element is disposed on an upper surface of the second pressure chamber, the first pressure chamber is arranged below the second pressure chamber and the first pressure chamber and the second pressure chamber have different distances to the nozzle plate, a flow passage distance of a first nozzle supply passage between the first pressure chamber and the first nozzle differs from a flow passage distance of a second nozzle supply passage between the second pressure chamber and the second nozzle, the second pressure chamber is farther away from the nozzle plate than the first pressure chamber, a common flow passage which supplies the liquid to the first pressure chamber and the second pressure chamber is provided in a layer located above the second piezoelectric element, a first supply side supply passage which leads the liquid from the common flow passage to the first pressure chamber and a second supply side supply passage which leads the liquid from the common flow passage to the second pressure chamber are straight extended directly below from a bottom surface of the common flow passage, a flow passage distance of the first supply side supply passage between the common flow passage and the first pressure chamber differs from a flow passage distance of the second supply side supply passage between the common flow passage and the second pressure chamber, the first nozzle supply passage and the second nozzle supply passage are formed to have flow passage shapes whereby acoustic resistances and acoustic inertances of the first nozzle supply passage and the second nozzle supply passage are approximately same, and the first supply side supply passage and the second supply side supply passage are formed to have flow passage shapes whereby acoustic resistances and acoustic inertances of the first supply side supply passage and the second supply side supply passage are approximately same.

2. The droplet discharging head according to claim 1, wherein the acoustic resistances and the acoustic inertances of the first nozzle supply passage and the second nozzle supply passage are approximately the same by setting values of at least one of cross-sectional area and length of the first nozzle supply passage and the second nozzle supply passage to be mutually different values.

3. The droplet discharging head according to claim 1, wherein at least one of the first nozzle supply passage and the second nozzle supply passage has a structure in which two or more flow passages of mutually different cross-sectional areas are combined.

4. The droplet discharging head according to claim 1, wherein the first nozzle supply passage and the second nozzle supply passage have a structure whereby cross-sectional area decreases gradually from the first pressure chamber and the second pressure chamber towards the first nozzle and the second nozzle.

5. The droplet discharging head according to claim 1, wherein the acoustic resistances and the acoustic inertances of the first supply side supply passage and the second supply side supply passage are approximately the same by setting values of at least one of cross-sectional area and length of the first supply side supply passage and the second supply side supply passage to be mutually different values.

6. The droplet discharging head according to claim 1, wherein at least one of the first supply side supply passage and the second supply side supply passage has a structure in which two or more flow passages of mutually different cross-sectional areas are combined.

7. The droplet discharging head according to claim 1, wherein the droplet discharging head is formed by superimposing a plurality of plate members, and has a structure where cross-sectional area of a flow passage is changed at a boundary face between the plate members.

8. The droplet discharging head according to claim 1, wherein approximately equal discharge performance is obtained by driving the first piezoelectric element and the second piezoelectric element by means of different drive waveforms, with respect to the first pressure chamber and the second pressure chamber.

9. An inkjet recording apparatus comprising:

an inkjet recording head including the droplet discharging head as defined in claim 1, wherein an image is recorded onto a recording medium by discharging the droplets from the first nozzle and the second nozzle, while causing the recording medium to move relatively with respect to the inkjet recording head.

* * * * *